United States Patent [19]

Horodysky

[11] Patent Number: 4,681,692

[45] Date of Patent: Jul. 21, 1987

[54] MULTIFUNCTIONAL LUBRICANT/FUEL ADDITIVES AND COMPOSITIONS THEREOF

[75] Inventor: Andrew G. Horodysky, Cherry Hill, N.J.

[73] Assignee: Mobil Oil Corporation, New York, N.Y.

[21] Appl. No.: 750,196

[22] Filed: Jul. 1, 1985

[51] Int. Cl.[4] ..... C10M 129/00; C10M 137/00

[52] U.S. Cl. ..... 252/32.5; 252/49.9; 549/352; 549/347

[58] Field of Search ..... 252/32.5, 49.9; 548/352, 347

[56] References Cited

U.S. PATENT DOCUMENTS 3,192,162 6/1965 Bartlett et al. ..... 252/46.6

4,216,334 8/1980 Jones ..... 252/32.5 X

*Primary Examiner*—Ferris H. Lander

*Attorney, Agent, or Firm*—Alexander J. McKillop; Michael G. Gilman; Howard M. Flournoy

[57] ABSTRACT

Zwitterionic (internal) imidazoline acid phosphates provide effective friction reducing and anti-wear characteristics for lubricant compositions when incorporated therein.

17 Claims, No Drawings

MULTIFUNCTIONAL LUBRICANT/FUEL ADDITIVES AND COMPOSITIONS THEREOF

BACKGROUND OF THE INVENTION

This invention is directed to lubricant compositions containing small additive concentrations of reaction products which possess excellent multifunctional activity. This invention is also directed to such additives as novel compositions of matter.

The need for friction reducing modifiers and antiwear additives in lubricating oils to meet the ever changing requirements of modern engines is well known. Various materials and various techniques have been proposed.

Imidazolines are well known for their lubricity properties and for their antirust and corrosion-inhibiting properties when formulated into lubricating oils and for their water scavenging and antirust characteristics when blended into fuels.

The use of phosphorus containing lubricating additives has also found widespread use. Phosphonates have been found to be lubricity and antiwear agents as exemplified by U.S. Pat. No. 4,356,097 which describes the use of hydrocarbyl phosphonates in lubricant formulations.

U.S. Pat. No. 4,478,732 describes imidazoline salts of acid phosphates and U.S. Pat. No. 4,318,817 describes phosphate acid esters as corrosion inhibitors in functional fluid such as hydraulic oils.

SUMMARY OF THE INVENTION

In accordance with the present invention the use of novel zwitterionic (internal) acid phosphate salts of imidazolines in lubricants provides effective antifriction and antiwear activity. These unique imidazoline-derived acid phosphates provide more effective friction reducing and antiwear activity than acid imidazolines that have been previously reported in the prior art. The exceptional benefits of these novel additives, coupled with the imidazoline moiety, apparently provide the basis for the significant synergistic antiwear activity.

These benfits are also expected for a variety of synthetic and mineral oil-based lubricants. These additives are useful as multifunctional additives in oils of lubricating viscosity, greases prepared therefrom and liquid hydrocarbyl or hydrocarbyloxy fuels.

The invention is accordingly directed to compositions comprising a major proportion of an oil of lubricating viscosity or grease prepared thereform, or a liquid hydrocarbyl or hydrocarbyloxy fuel and a minor friction reducing/antiwear amount proportion of a hydroxyhydrocarbyl hydrocarbyl imidazoline-derived Zwitterionic acid phosphate as described herein below. The invention is also directed to additive products comprising the subject imidazoline-derived acid phosphates and to a means of reducing the fuel consumption of engines preferably internal combustion engines by treating the moving parts thereof with the instant compositions.

DESCRIPTION OF THE PREFERRED EMBODIMENTS

The imidazolines defined herein are generally prepared by reacting a suitable imidazoline with phosphorous pentoxide. The imidazoline-derived phosphates in accordance with the present invention therefore may be prepared by the following generalized reaction:

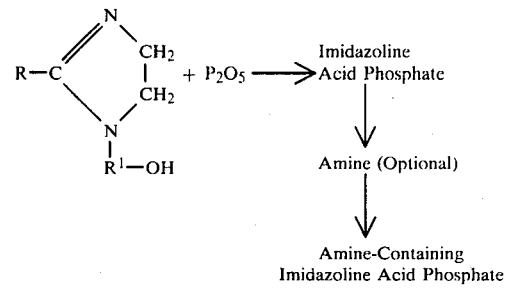

where R is from about $C_6$ to about $C_{30}$ hydrocarbyl and preferably $C_{12}$ to $C_{18}$ hydrocarbyl or hydrocarbyl substituted with oxygen or sulfur, and $R^1$ is from $C_1$ to about $C_6$ hydrocarbyl or oxygen or sulfur substituted hydrocarbyl. R can also contain nitrogen.

Less than molar quantities, molar quantities, or more than molar quantities of the phosphorus pentoxide can be effectively used. The imidazoline acid phosphate can then be optionally treated with a nitrogenous base such as a hydrocarbyl amine.

A mixture of products is believed to form during the imidazoline-phosphorous pentoxide reaction. At least a portion is believed to contain the zwitterionic imidazoline acid phosphate salt.

Amines useful herein include $C_1$–$C_{32}$ hydrocarbyl amines, such as oleylamine, stearylamine, tallowamine, alkoxylated amines, hydrocarbyl diamines such as N-oleyl-1,3-propylenediamine or triamines, imidazolines, amine-containing polyisobutyenyl-succinimides diamine, etheramine, or etherdiamine, and the like. Such amines usually contain from 2 to about 32 carbon atoms ($C_2$–$C_{32}$) or more. More preferred are $C_{11}$–$C_{13}$ tertiary alkyl amines. To obtain the amine-containing product generally less than molar quantities of a suitable amine is reacted at about 50°–100° C. under appropriate conditions with the imidazoline acid phosphate salt.

The reactants may be obtained commercially or they may be prepared by any process of reaction known to the art. For example, the hydroxyalkyl hydrocarbyl imidazolines can be formed by the reaction of various carboxylic acids or mixtures thereof with appropriate hydroxyalkylamines such as ethanolamine and the like. Suitable acids include maleic, oleic, stearic, isostearic, tallowacids, decanoic and similar fatty acids.

The imidazoline is preferably reacted with $P_2O_5$ in less than molar quantities to product the desired imidazoline acid phosphate. Reaction temperatures may range from about 50° to about 180° C. and preferably from about 100° to 150° C. Solvents preferably are used. Hydrocarbon solvents such as toluene, xylene, heptane and the like are highly useful.

The additives embodied herein are useful in lubricating oil and greases (or liquid hydrocarbyl or hydrocarbyloxy fuels) in an amount which imparts significant friction modifying/antiwear characteristics to the oil, thereby reducing the friction of an engine operating with the oil in its crank case. Concentrations of about 0.01 to about 10 wt.% based on the total weight of the composition are normally used. Preferably, the concentration is from about 0.1 to about 3 wt.%.

Of particular significance in accordance with the present invention is the ability to improve both the antiwear characteristics and friction reducing characteristics of oleaginous materials such as hydrocarbyl lubricating media which may comprise liquid oils in a form of either a mineral oil or a synthetic oil or mixtures thereof, or in the form of a grease in which any of the aforementioned oils are employed as a vehicle. In general, mineral oils, both paraffinic, napthenic and mixtures thereof, employed as the lubricant, or grease vehicle, may be of any suitable lubricating viscosity range, as for example, from about 45 SSU at 100° F. to about 6000 SSU at 100° F., and preferably, from about 50 to about 250 SSU at 210° F. These oils may have viscosity indexes ranging to about 100 or higher. Viscosity indexes from about 70 to about 95 are preferred. The average molecular weights of these oils may range from about 250 to about 800.

Where the lubricant is to be employed in the form of a grease, the lubricating oil is generally employed in an amount sufficient to balance the total grease composition, after accounting for the desired quantity of the thickening agent, and other additive components to be included in the grease formulation. A wide variety of materials may be employed as thickening or gelling agents. These may include any of the conventional metal salts or soaps, such as lithium or calcium stearates or hydroxy stearates which are dispersed in the lubricating vehicle in grease-forming quantities in an amount sufficient to impart to the resulting grease composition the desired consistency.

Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any materials which are normally employed for thickening or gelling hydrocarbon fluids for forming grease can be used in preparing the aforementioned improved grease in accordance with the present invention.

In instances where synthetic oils, or synthetic oils to be employed as the vehicle for grease formulations, are desired in preference to mineral oils, or in combination therewith, various compounds of this type may be successfully utilized. Typical synthetic vehicles include, but are not limited to, polyisobutylene, polybutenes, hydrogenated polydecenes, polypropylene glycol, polyethylene glycol, trimethylolpropane esters, neopentyl and pentaerythritol esters, di(2-ethylhexyl)sebacate, di(2-ethylhexyl)adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl)ether and phenoxy phenylethers.

It is to be understood, however, that the compositions contemplated herein can also contain other materials. For example, corrosion inhibitors, extreme pressure agents, viscosity index improvers, co-antioxidants, other antiwear agents and the like can be used. Included are metallic phenates or sulfonates, metallic phosphorodithioates polysuccinimides and the like. These materials do not detract from the value of the compositions of this invention, rather the materials serve to impart their customary properties to the particular compositions into which they are incorporated.

The following examples illustrate the invention. They are illustrative only and are not meant to limit it.

EXAMPLE 1

Acid Phosphate of Hydroxyalkyl Alkenylimidazole

Approximately 350 g of 1-(2-hydroxyethyl)-2-heptadecenylimidazoline (obtained commercially as Amine-O from Ciba-Geigy, Inc.) and 50 g n-hexane were placed in a one liter glass reactor equipped with heater, agitator, condensor, and provision for maintaining inert nitrogen atmosphere. Approximately 40 g of phosphorus pentoxide was added incrementally over a period of two hours. The reaction temperature was then raised to 110° C. for two hours and 130° C. for two hours. At the end of this reaction period, the $P_2O_5$ appeared to have completely reacted. The solvent was removed by vacuum distillation at 125° C. The product as filtered hot through diatomaceous earth to form a clear, amber-colored viscous fluid.

EXAMPLE 2

Acid Phosphate of Hydroxyalkyl Alkenylimidazoline

Approximately 175 g of 1-(2-hydroxyethyl)-2-heptadecenylimidazoline and 100 ml n-hexane were placed in a reactor equipped as generally described in Example 1. After warming reactor contents to 65° C., approximately 24 g phosphorus pentoxide was added incrementally over a period of 1½ hours. The reaction mixture was heated at 90°–100° C. for a total of 7 hours. The solvent was removed by vacuum distillation at 100° C. The crude product was diluted at this point with two parts by weight of 100 second solvent paraffinic neutral lubricating diluent oil to form a 33⅓% active additive concentrate in oil. The crude product was filtered hot through diatomaceous earth to form a clear amber-colored viscous concentrate.

The products were blended into fully formulated oils and evaluated for their friction reducing properties as shown in Table 1 and Table 2 in the Low Viscosity Friction Apparatus (LVFA). The LVFA and test procedure is described in U.S. Pat. No. 4,252,973, the pertinent portions of which are hearby incorporated herein.

TABLE 1

| | Frictional Characteristics | | |
|---|---|---|---|
| | Additive Concentration | Reduction or % Change in Coefficient of Friction | |
| | Wt. % | 5 Ft/Min. | 30 Ft/Min. |
| Base Oil A (fully formulated synthetic engine oil containing detergent/dispersant/inhibitor performance package) SAE 10W/30 | — | 0 | 0 |
| Example 1 - Acid phosphate of 1-(2-hydroxyethyl)-2-heptadecenyl imidazoline | 4 | 37 | 27 |
| | 2 | 27 | 20 |

TABLE 2

| | Frictional Characteristics | | |
|---|---|---|---|
| | Additive Concentration | Reduction or % Change in Coefficient of Friction | |
| | Wt. % | 5 Ft/Min. | 30 Ft/Min. |
| Base Oil B (fully formulated mineral oil based engine containing detergent/disper- | — | 0 | 0 |

TABLE 2-continued

| | Frictional Characteristics | | |
|---|---|---|---|
| | Additive Concentration | Reduction or % Change in Coefficient of Friction | |
| | Wt. % | 5 Ft/Min. | 30 Ft/Min. |
| sant/inhibitor performance package) SAE 10W/40 | | | |
| Example 1 - Acid phosphate | 4 | 34 | 26 |
| of 1-(2-hydroxyethyl)- | 2 | 34 | 24 |
| 2-heptadecenyl imidazoline | | | |

The products of the examples were blended into mineral oil at 1% concentration and evaluated using the Four-Ball Wear Test using a 60 kg load at 1500 rpm for thirty minutes as shown in Table 3.

TABLE 3

| | Four-Ball Wear Test Results* | |
|---|---|---|
| | Additive Concentration Wt. % | Scar Diameter, mm (60 kg load, 1500 RPM 200° F., 30 Minutes |
| Base Oil C(Mixture of 80% solvent parafinninic bright and 20%, 200 second solvent parafinnic neutral lubricating oils) | — | 1.98 |
| Example 2 - Acid phosphate of 1-(2-hydroxyethyl)- 2-heptadecenyl imidazoline | 1% | 0.70 |

*ASTM D2266, see U.S. Pat. No. 4,434,291.

The data disclosed in Table 1 or Table 2 and Table 3 clearly demonstrate the friction-modifying and antiwear effectiveness of the compositions which contain the internal acid phosphate salts described herein. They are useful at low concentrations, are ashless and do not contain any potentially undesirable sulfur or metallic salts. They may be readily prepared in a process, comparable in many respects to known reactions currently practiced commercially.

Although the present invention has been described with preferred embodiments, it is to be understood that modifications and variations may be resorted to, without departing from the spirit and scope of the invention, as those skilled in the art will readily understand. Such modifications and variations are considered to be within the purview and scope of the appended claims.

What is claimed is:

1. A composition comprising a major proportion of an oil of lubricating viscosity or grease prepared therefrom and a minor friction reducing or antiwear proportion of an imidazoline derived internal acid phosphate prepared by reacting a hydrocarbyl imidazoline in the following generalized reaction with phosphorus pentoxide:

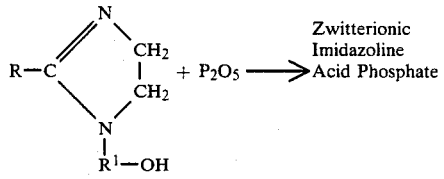

where R is about $C_6$ to about $C_{30}$ hydrocarbyl or hydrocarbyl substituted with oxygen or sulfur and/or nitrogen and $R^1$ is $C_1$ to about $C_6$ hydrocarbyl.

2. The composition of claim 1 wherein the reaction is carried out at temperatures of from about 50° to about 180° C. with less than molar quantities of phosphorus pentoxide.

3. The composition of claim 2 wherein the phosphorus pentoxide is added incrementally to the reaction mixture.

4. The composition of claim 2 wherein the reaction with $P_2O_5$ is carried out at temperatures ranging from about 110° to about 150° C.

5. The composition of claim 1 wherein the imidazoline acid phosphate is thereafter reacted with a $C_2$ to about a $C_{32}$ hydrocarbonyl amine, diamine, etheramine or etherdiamine to produce an amine-containing internal imidazoline acid phosphate.

6. The composition of claim 5 wherein the amine is a $C_{11}$–$C_{13}$ tertiary alkyl amine.

7. The composition of claim 1 wherein said major proportion is selected from the group consisting of mineral oils, synthetic oils or mixtures thereof.

8. The composition of claim 6 wherein said major proportion is a mineral oil.

9. The composition of claim 6 wherein said major proportion is a synthetic oil.

10. The composition of claim 6 wherein said major proportion is a grease.

11. The composition of claim 1 wherein the imidazoline derived acid phosphate is prepared by reacting 1-(2-hydroxyethyl)-2-heptadecenylimidazoline with $P_2O_5$.

12. An additive product consisting of an imidazoline derived internal acid phosphate prepared by reacting a hydroxyalkyl hydrocarbyl imidazoline in the following generalized reaction with phosphorus pentoxide:

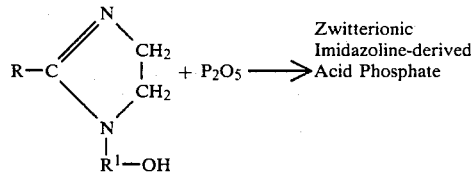

where R is about $C_6$ to about $C_{30}$ hydrocarbyl or hydrocarbyl substituted with sulfur or oxygen and/or nitrogen and $R^1$ is $C_1$ to about $C_6$ hydrocarbyl or oxygen or sulfur substituted hydrocarbyl.

13. The additive product of claim 12 wherein the reaction is carried out at temperatures of from about 50° to about 180° C. with less than molar quantities of phosphorus pentoxide.

14. The additive product of claim 13 wherein the $P_2O_5$ is added to the reaction incrementally.

15. The additive product of claim 12 wherein said Zwitterionic imidazoline-derived acid phosphate is prepared by reacting 1-(2-hydroxyethyl)-2-heptadecenylimidazoline with $P_2O_5$.

16. The additive product described in claim 12 wherein it is further reacted with a $C_1$ to about a $C_{32}$ hydrocarbyl amine, diamine or etheramine or etherdiamine to produce an amine-containing internal acid phosphate.

17. The additive product of claim 15 wherein the amine is a $C_{11}$–$C_{13}$ tertiary alkyl amine.

* * * * *